US005738396A

United States Patent [19]

Oestermeyer et al.

[11] Patent Number: 5,738,396

[45] Date of Patent: Apr. 14, 1998

[54] UNIVERSAL LATCH SYSTEM FOR RAILROAD CAR HATCH COVERS

[75] Inventors: David A. Oestermeyer, Downers Grove; Brian D. Putnam, Bolingbrook; William F. Burian, Downers Grove, all of Ill.

[73] Assignee: Salco Products, Inc., Lemont, Ill.

[21] Appl. No.: 637,926

[22] Filed: May 1, 1996

[51] Int. Cl.[6] ..... E05B 65/00

[52] U.S. Cl. ..... 292/256.5; 292/259 R; 16/233; 16/235; 16/389; 105/377.11

[58] Field of Search ..... 292/256.5, 256, 292/259 R, DIG. 54, DIG. 60; 105/377.11, 377.07; 16/233, 235, 389

[56] References Cited

U.S. PATENT DOCUMENTS

| | | | |
|---|---|---|---|
| 923,037 | 5/1909 | Ellerbe | 16/235 |
| 2,324,356 | 7/1943 | Brown | 292/259 R |
| 4,388,873 | 6/1983 | Carleton et al. | 292/259 R X |
| 4,461,219 | 7/1984 | Bateson | 105/377.07 |
| 4,570,816 | 2/1986 | Ferris et al. | 292/256.5 X |
| 4,622,902 | 11/1986 | Miller | 292/DIG. 60 X |
| 4,655,365 | 4/1987 | Miller | 292/256.5 X |
| 4,858,972 | 8/1989 | Salyer | 292/DIG. 60 X |
| 4,889,056 | 12/1989 | Stewart | 292/256.5 X |
| 4,961,387 | 10/1990 | Kneebone et al. | 105/377.07 |
| 5,314,218 | 5/1994 | Nadherny et al. | 292/256.5 |
| 5,622,117 | 4/1997 | Burian et al. | 105/377.07 |

FOREIGN PATENT DOCUMENTS

| | | | |
|---|---|---|---|
| 470790 | 4/1952 | Italy | 292/259 R |

*Primary Examiner*—Rodney M. Lindsey
*Attorney, Agent, or Firm*—Dorn, McEachran, Jambor & Keating

[57] ABSTRACT

A latch system for retaining hatch covers on railroad cars can accommodate any hatch cover type made by any car builder. The latch has a universal arm with a custom-made hinge adapter at one end for pivotally connecting the arm to any hatch design or cover type. The other end of the arm mounts a catch adaptor which receives a catch bolt for retaining the arm in a closed position. The arm also has fittings for accepting brackets and wings for vented hatch covers.

11 Claims, 2 Drawing Sheets

48
10
62
60
2
2
44
44
56
62
58
52A
54

10
46
38
40
34
46
56
28
37
32
26
52A
54
44
50
48
42
50
14
44
22
36
30
24
16
12
18
20
46
52A
44
54
50
38
50
62
26
62
32
34

UNIVERSAL LATCH SYSTEM FOR RAILROAD CAR HATCH COVERS

BACKGROUND OF THE INVENTION

This invention concerns a latching system for retaining hatch covers on railroad cars such as hopper cars. A hatch or manway is an opening on top of a car that provides access to the interior of the car for loading, venting and maintenance purposes. The opening is usually round with about a twenty inch diameter, although other sizes and shapes are possible. A hatch cover is connected to an elongated latch arm which in turn is hinged at one end to the loading nozzle for opening and closing the hatch. The loading nozzle is an upstanding tube surrounding the opening in the car body. The nozzle may be a plain cylindrical tube or it may have a rounded top edge known as a coaming. A catch fixed to the nozzle is releasably engageable with the end of the latch arm opposite the hinge for holding the cover closed. A loading nozzle mounting a vented hatch cover is shown in U.S. Pat. No. 5,064,089, the disclosure of which is incorporated herein by reference.

Some hatch covers have built-in vents while others are unvented. Vented hatch covers have a markedly different shape from that of unvented covers and thus the two types have in the past required different latch arms in order to connect the covers to the arms. In addition to the different cover types, there are at present in the United States at least three major car manufacturers, all of whom provide different hinge designs for attachment to the latch arms. None of these hinge designs are interchangeable with any other; latch arms for one manufacturer's car will not fit another maker's car. Accordingly, fleet operators' maintenance shops must stock at least six different latch arm types for repair of latches, hinges or catches and/or changeover of cover types. The prior art latch arms are fairly heavy, bulky items that create a storage problem since a large inventory of the different types must be stocked. And that inventory ties up a fair amount of capital. The present invention is directed to reducing the size of the latching arm inventory.

SUMMARY OF THE INVENTION

This invention relates to a latching arm system for retaining railroad car hatch covers. The system comprises a universal, elongated arm having first and second attachment elements at each end thereof. Intermediate the ends are bracket and wing attachment elements used with vented covers. The arm can be used with any type of cover and with the hinge of any car manufacturer. A hinge adaptor is connected to the first attachment element. The hinge adaptor is a relatively short corner member that is designed to fit a particular manufacturer's hinge. A hinge adaptor is provided for each manufacturer. A catch adaptor is connected to the second attachment element. The catch adaptor is a relatively small casting that is designed to engage the catch bolt attached to the nozzle. At the present time one catch adaptor will work with all manufacturer's catch bolts but should a change be made in a catch bolt configuration, all that would be needed is a new catch adaptor to fit the new design. A locking clasp maintains engagement of the bolt and catch adaptor.

DETAILED DESCRIPTION OF THE INVENTION

Figures 1, 2, 3:
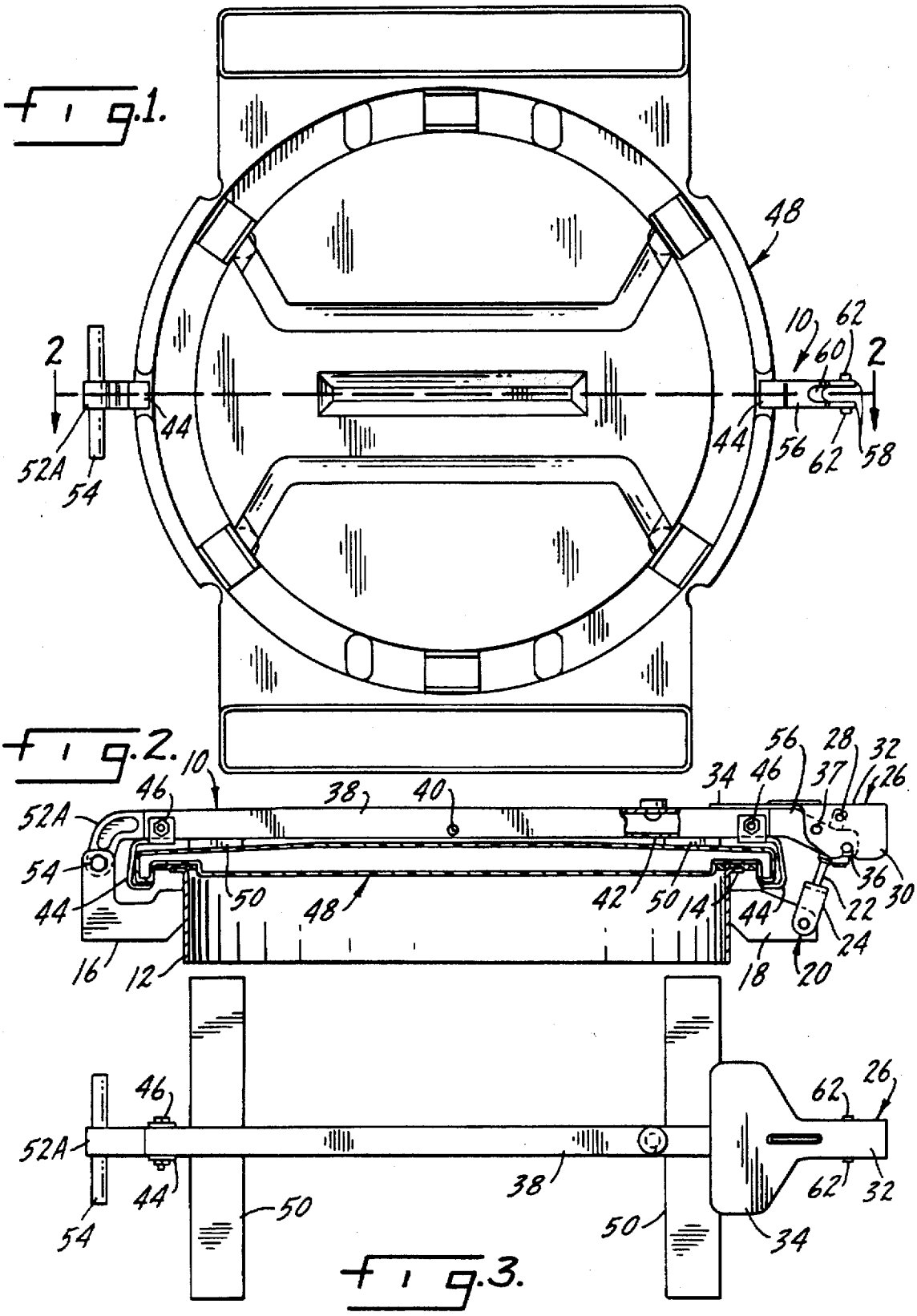
FIG. 1 is a bottom plan view of a vented hatch cover and latch according to the present invention.
FIG. 2 is a section taken along line 2—2 of FIG. 1.
FIG. 3 is a plan view of a latching arm for a vented hatch cover.

FIGS. 1–3 illustrate the latch system 10 of the present invention installed on the loading nozzle 12 of a railroad car hatch. The top edge of the nozzle has a turned over flange or coaming 14. One side of the nozzle mounts a hinge bracket 16 while the opposite side has a catch bracket 18. It will be understood that the hinge bracket 16 will vary from one car manufacturer to the next. For example, present car builders in the United States include ACF, Trinity and Pullman. They all make the hinge bracket differently. The catch brackets and catch bolts, however, are similar from one builder to the next.

The catch bracket 18 has a catch bolt 20 pivotally connected thereto. The catch bolt itself has a shank 22 attached to a clevis 24 at one end. The other end of shank is pivotally connected to a locking clasp 26 by means of a pin 28. The locking clasp has a pair of spaced side plates 30 joined by a top plate 32 which flares out into a widened handle portion 34 (FIG. 3). Each side plate 30 has an open slot 36 on its lower edge and a hole 37. Operation of the catch bolt and locking clasp will be described below.

The latch system 10 includes a central, elongated arm 38. In a preferred embodiment the arm is a hollow member having a generally square cross section. For reference purposes only, the arm may be an aluminum extrusion about twenty-three inches long and about one inch square on the outside dimension, with a 0.125" wall thickness. The ends of the arm 38 have attachment elements which allow the arm to receive the hinge and catch adaptors as will be explained more fully below. Bolt holes near the ends of the arm comprise part of the attachment elements. The arm also has a central bolt hole 40 for mounting an unvented hatch cover. There is a drain opening 42 in the bottom of the arm to allow for drainage.

C-shaped hatch cover brackets 44 may be bolted to the arm when a vented hatch cover is being used. Bolts 46 extend through the holes in the ends of the arm for attaching both the cover brackets 44 and the hinge and catch adaptors. A vented hatch cover is shown at 48 in FIG. 1. Details of the vented hatch cover are shown in U.S. Pat. No. 5,064,089. The brackets 44 surround the outer edges of the cover to attach the cover to the arm. Pressure plates or wings 50 are attached to the bottom of the arm for use with a vented hatch cover.

A hinge adaptor is shown generally at 52A. It has a plug that fits inside the end of the arm 38 and is retained by bolt 46. A hinge pin 54 is pivotally mounted in the hinge bracket 16 and extends through an opening in the adaptor 52A. A catch adaptor 56 is attached to the opposite end of arm 38. It has a plug similar to that of the hinge adaptor for retention by one of the bolts 46. The outer end of the catch adaptor has a pair of prongs 58 which define a slot 60 between them. Each prong carries a small peg 62 on it outside surface. There is a bore 64 (FIG. 5) through the central portion of the adaptor 56.

Figure 4:
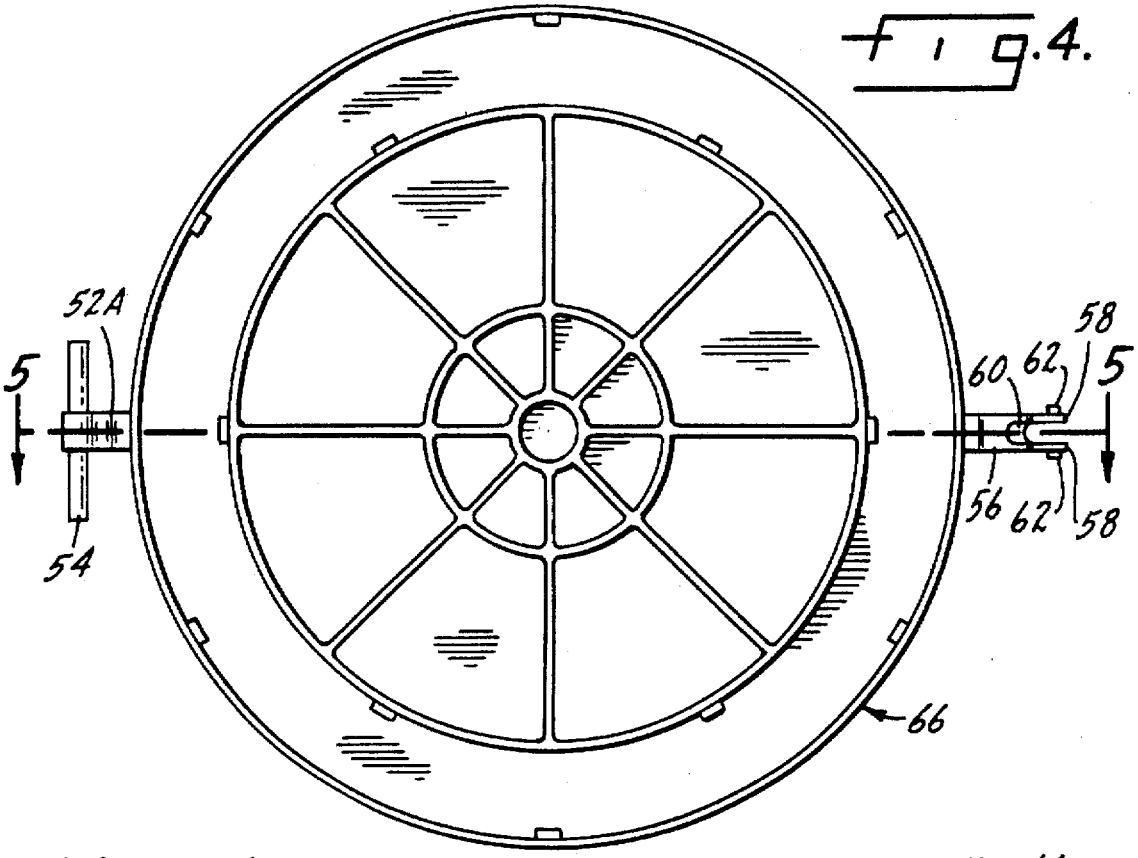
FIG. 4 is a bottom plan view of an unvented hatch cover and latch according to the present invention.
Figure 5:
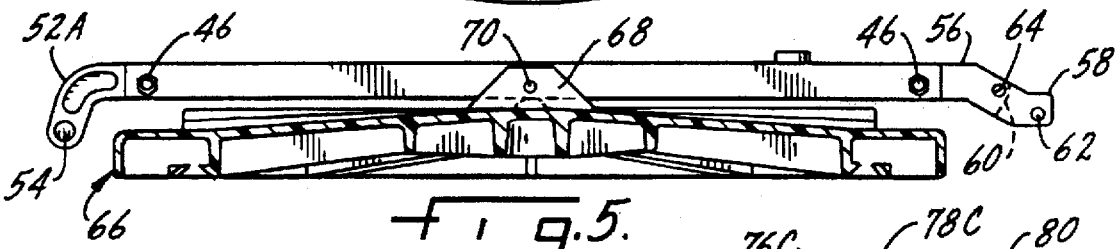
FIG. 5 is a section taken along line 5—5 of FIG. 4.

FIGS. 4 and 5 illustrate the latch system of the present invention mounting an unvented hatch cover 66. The unvented cover has a pair of upstanding tabs 68 on its top surface which receive a mounting pin 70 for attaching the cover to the arm 38. Bolts 46 connect the hinge adaptor 52A and catch adaptor 56 to the ends of the arm.

Figure 6:
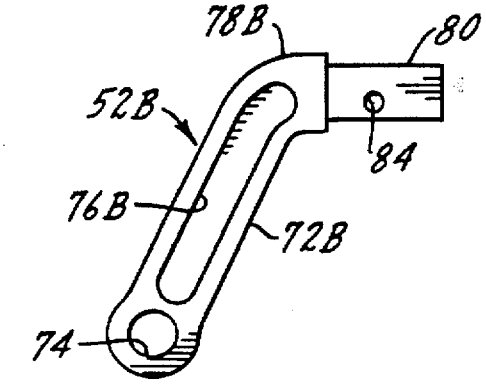
FIG. 6 is a side elevation view of one hinge adaptor.
Figure 7:
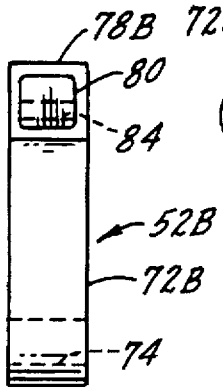
FIG. 7 is an end elevation view of the hinge adaptor of FIG. 6.
Figure 8:
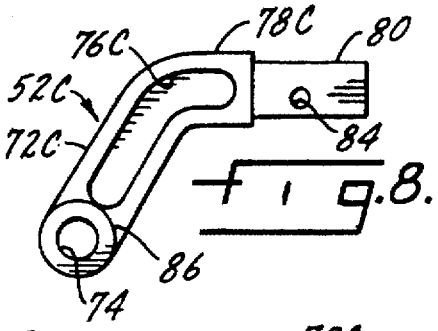
FIG. 8 is a side elevation view of a different hinge adaptor for a different manufacturer's hinge.
Figure 9:
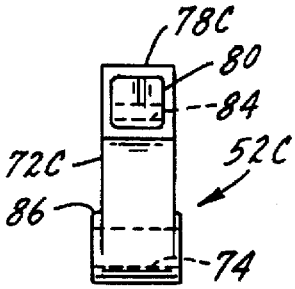
FIG. 9 is an end elevation view of the hinge adaptor of FIG. 8.

FIGS. 6 and 7 show the details of an alternate hinge adaptor 52B. The adaptor has a coupler portion 72B with a through hole 74 at the lower end for receipt of the hinge pin 54. Depressions 76B are located in the sides of the coupler portion for lightening the casting. An elbow 78B at the upper end of the coupler terminates at a connector in the form of a solid plug 80. The plug has a square shape that fits snugly inside the hollow arm 38. Bore 84 accepts the retainer bolt 46. FIGS. 8 and 9 show a further alternate hinge adaptor 52C which is essentially similar to adaptors 52A and 52B except the coupler portion 72C is somewhat shorter than coupler 72B and there is a boss 86 at the lower end. Adaptor 52A has an even shorter coupler portion but is otherwise similar to adaptors 52B and 52C.

The use, operation and function of the latch system are as follows. Considering the vented hatch cover of FIGS. 1–3, a user would first attach the wings 50 to the arm 38. Next the appropriate hinge adaptor 52 is inserted in one end of the arm and the catch adaptor 56 is inserted in the other end. Then the brackets 44 are placed around the edges of the cover and the arm is laid over the cover and between the tabs of the brackets 44. Bolts 46 are inserted through the brackets 44, arm 38 and plugs of the hinge and catch adaptors. To install the cover on a car, it is laid onto the hatch and the hinge pin 54 is placed through the hinge bracket 16 and the hole 74. The hinge pin may be retained in any appropriate manner.

To latch the cover, the bolt 20 is rotated about clevis 24 counterclockwise as seen in FIG. 2 so the shank 22 resides in slot 60 of the catch adaptor 56. The locking clasp 26 is rotated clockwise (as seen in FIG. 2) about pin 28 so that the slots 36 in side plates 30 receive the pegs 62 on the catch adaptor 56. Then the user pushes the handle 34 down toward the arm 38 until the handle lies flush against the arm as shown in FIG. 2. In this position the holes 37 in locking clasp 26 are aligned with the bore 64 in the catch adaptor 56 so that a cotter pin (not shown) or the like may be inserted to prevent inadvertent release of the locking clasp.

Changeover from the vented hatch cover 48 to an unvented cover 66 is done as follows. The locking clasp is released by reverting the steps just described. Removal of hinge pin 54 then frees the arm 38 and cover 48 from the hatch nozzle. Bolts 46 are removed to detach brackets 44 from the arm 38. This releases the cover from the arm. Wings 50 are also removed. If a different hinge adaptor is needed it can be inserted in the end of the arm. Otherwise, the same hinge adaptor and catch adaptor are then re-inserted and fastened by bolts 46. Next the arm is placed between tabs 68 of the unvented hatch cover and the pin 70 is installed to connect the arm to the cover. With the cover placed on the hatch, hinge pin 54 is installed and locking clasp 20 is closed to complete the changeover. Note that the same arm 38 and catch adaptor 56 are used for either type of cover. If the new cover is going on the same car, the same type of hinge adaptor is used. If the new cover is going on a different car, only the hinge adaptor need be changed, the other parts are used again. This system greatly reduces the amount of inventory that must be kept for different car and cover types.

While a preferred form of the invention has been shown and described, it will be realized that alterations and modifications may be made thereto without departing from the scope of the following claims.

We claim:

1. A latch system for connecting railroad car hatch covers to a loading nozzle equipped with a catch bolt and a hinge bracket, comprising:

an elongated arm having first and second ends and cover attachment means intermediate the ends of the arm for connecting the arm to a hatch cover, and the arm further including first and second attachment elements at the first and second ends of the arm, respectively;

a hinge adaptor having a connector and a coupler, the connector being removably attached to the first attachment element of the arm, the coupler being arranged to pivotably connect to a particular car manufacturer's hinge bracket; and a catch adaptor removably attached to the second attachment element of the arm and arranged to be engageable with the catch bolt attached to the loading nozzle.

2. The latch system of claim 1 further comprising a locking clasp pivotally attached to the catch bolt and engageable with the catch adaptor for maintaining engagement of the catch bolt and catch adaptor.

3. The latch system of claim 1 wherein the cover attachment means comprises a pair of brackets connected to the arm and engageable with a hatch cover.

4. The latch system of claim 1 further comprising wing attachment elements intermediate the ends of the arm.

5. The latch system of claim 1 wherein the elongated arm is a hollow tube of non-circular cross section.

6. The latch system of claim 5 wherein the hinge adaptor connector is a projecting plug sized and shaped to fit telescopically inside the hollow tube.

7. The latch system of claim 5 wherein the catch adaptor comprises a projecting plug sized and shaped to fit telescopically inside the hollow tube.

8. The latch system of claim 5 further comprising a drain opening in the arm.

9. A latch system for connecting railroad car hatch covers of multiple types to a loading nozzle equipped with a catch bolt and a hinge bracket of multiple types, comprising a universal arm usable with any one of the multiple hatch cover types, a plurality of hinge adaptors each having a connector and a coupler, the connector being removably attachable to the arm and the coupler being pivotally connectable to the hinge bracket, the connectors for all hinge adaptors being essentially similar while the couplers are individually designed to extend to and join with the hinge bracket of a particular type, one of the hinge adaptors being connected to the arm when the arm is in use.

10. The latch system of claim 9 further comprising a catch adaptor removably attached to the arm and arranged to be engageable with the catch bolt attached to the loading nozzle.

11. The latch system of claim 9 further comprising a locking clasp pivotally attached to the catch bolt and engageable with the catch adaptor for maintaining engagement of the bolt and catch adaptor.

* * * * *